United States Patent [19]

Aylott

[11] Patent Number: 5,005,595

[45] Date of Patent: Apr. 9, 1991

[54] FINGERNAIL REPAIR

[75] Inventor: David H. Aylott, Tomarton, United Kingdom

[73] Assignee: Eylure Limited, Wales

[21] Appl. No.: 298,389

[22] Filed: Jan. 18, 1989

[30] Foreign Application Priority Data

Jan. 19, 1988 [GB] United Kingdom ..... 8801107

[51] Int. Cl.[5] ..... A45D 29/00

[52] U.S. Cl. ..... 132/73; 132/200

[58] Field of Search ..... 132/73, 200

[56] References Cited

U.S. PATENT DOCUMENTS

| | | | |
|---|---|---|---|
| 3,750,684 | 8/1973 | Russell | 132/73 |
| 4,135,526 | 1/1979 | Matranga et al. | 132/73 |
| 4,596,260 | 6/1986 | Giuliano | 132/73 |
| 4,627,453 | 12/1986 | Isler | 132/73 |

FOREIGN PATENT DOCUMENTS

| | | | |
|---|---|---|---|
| 0167329 | 1/1986 | European Pat. Off. | 132/73 |
| 2451724 | 10/1980 | France | 132/73 |

*Primary Examiner*—John J. Wilson
*Assistant Examiner*—F. LaViola
*Attorney, Agent, or Firm*—Blum Kaplan

[57] ABSTRACT

A nail repair device for repairing a split or broken fingernail or for cosmetically enhancing the appearance of a fingernail has a support portion for positioning underneath the natural nail and a handle portion of which the support portion may be manipulated into position. The fixture is effected by applying adhesive to the support portion, positioning the support portion firmly under the natural nail to secure the nail repair device to the natural fingernail and then removing the handle portion. The support portion suitably has a lip which may be butted up against the edge of the natural fingernail. The support portion may be trimmed to leave a forward part protruding and a nail extension may be applied to the protruding part.

11 Claims, 4 Drawing Sheets

FINGERNAIL REPAIR

This invention relates to means for repairing a fingernail or otherwise cosmetically enhancing the appearance of a natural fingernail hereinafter simply referred to as nail means. The invention also includes a method of repairing or cosmetically enhancing the appearance of a natural fingernail.

Split or broken fingernails are a problem which face not just women but also men. At present women either cut the nail back or, particularly if the split reaches the quick of the nail, apply an artificial fingernail over the top or simply apply fingernail adhesive to the split and file it smooth. Men just cut the nail back as best they can.

According to the present invention there is provided nail means for repairing a split or broken natural fingernail or cosmetically enhancing the appearance of a fingernail comprising a support portion for positioning underneath the natural nail and a handle portion by means of which the support portion may be manipulated into position.

The invention also includes a method of repairing a split or broken natural fingernail or cosmetically enhancing the appearance of a natural fingernail comprising the steps of:

providing a nail means having a support portion and a handle portion by which the support portion may be manipulated;

applying adhesive to one of the underneath of the natural fingernail or the support portion;

manipulating the nail means so as to position the support portion in contact with the underneath of the natural fingernail with the adhesive therebetween so as to secure the nail means to the underneath of the natural fingernail; and separating the handle portion from the support portion. Suitably the method includes shaping the support portion as desired.

The nail means may be stepped on its upper surface to include a lip in which case the support portion is positioned underneath the natural fingernail with the lip in contact with the edge of the natural fingernail. The handle portion is suitably cut from the support portion and the remainder of the nail means filed or buffed to the desired final shape. If desired, prior to shaping, acrylic powder may be applied to the upper surface of the support portion with adhesive at the edge of the natural nail to enhance the appearance of the edge of the repaired nail or to fill out the natural fingernail, e.g. if a part of the natural nail has actually broken away or been cut away.

Preferably the support portion is about as wide as the width of a natural nail and has a forward edge curved to match the natural curvature at the tip of a natural fingernail. Alternatively, a section would be used to go underneath the nail and repair a split without extending right across the width. Suitably the handle portion is made of thicker material so as to be stronger than the support portion and is inclined to curve away from the support portion to improve the application of pressure on the support portion during securing to ensure a strong bond.

The invention will now be described by way of example with reference to the accompanying drawings in which.

Figure 1:
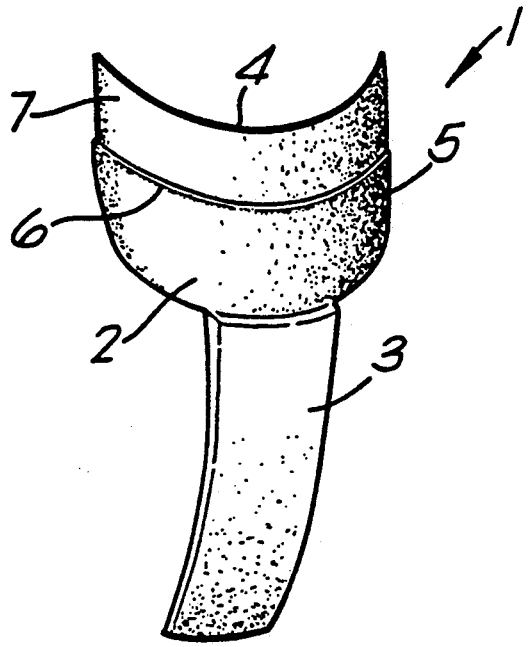
FIG. 1 is a front perspective view from above and one side of a preferred embodiment of nail means.
Figure 2:
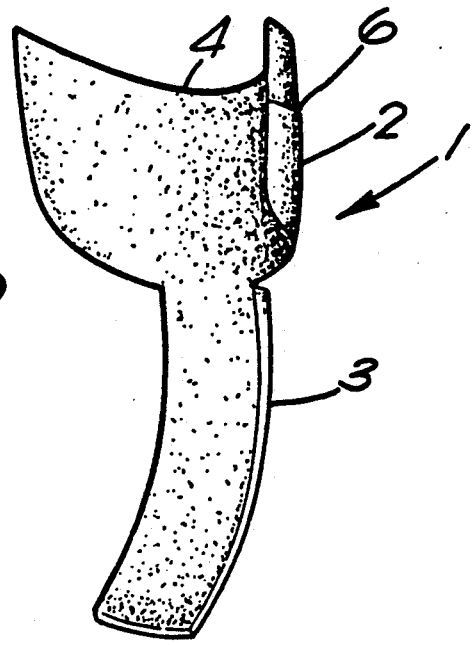
FIG. 2 is a rear perspective view of the nail means of FIG. 1 from below.
Figure 3A:
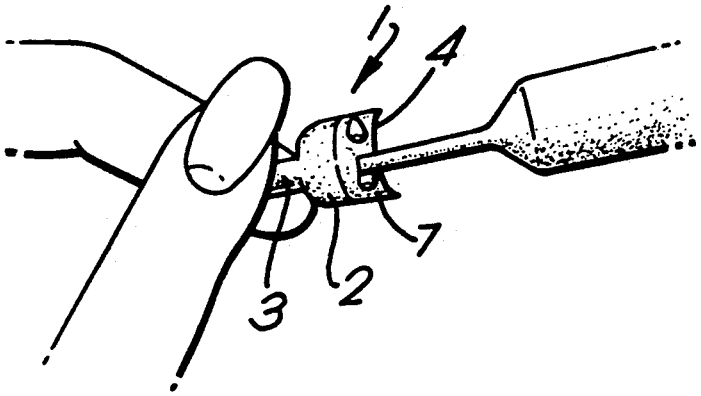
Figure 3B:
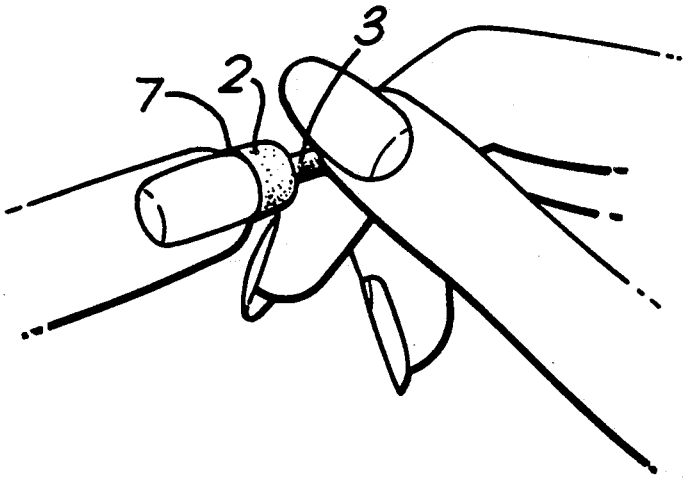
Figure 3C:
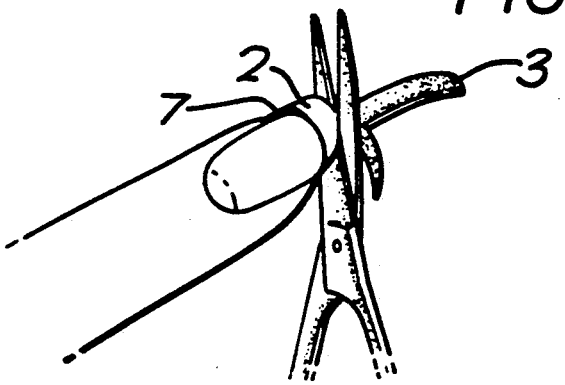
Figure 4:
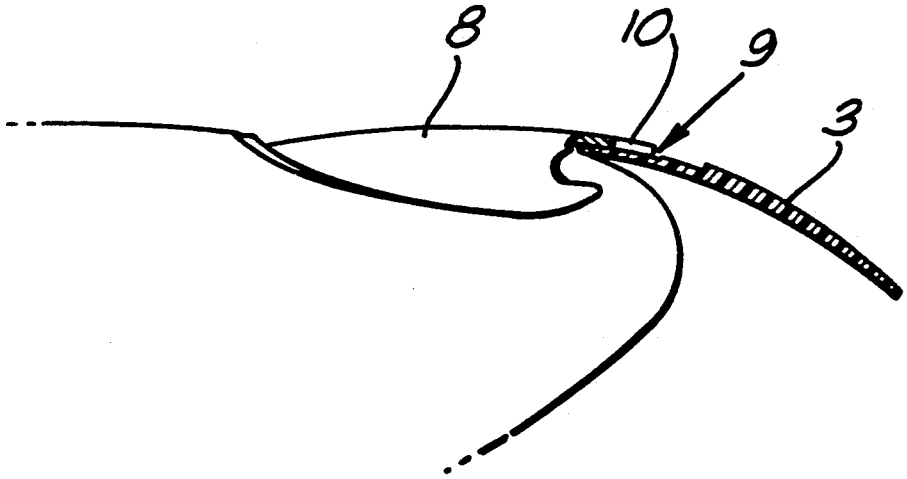
Figure 5:
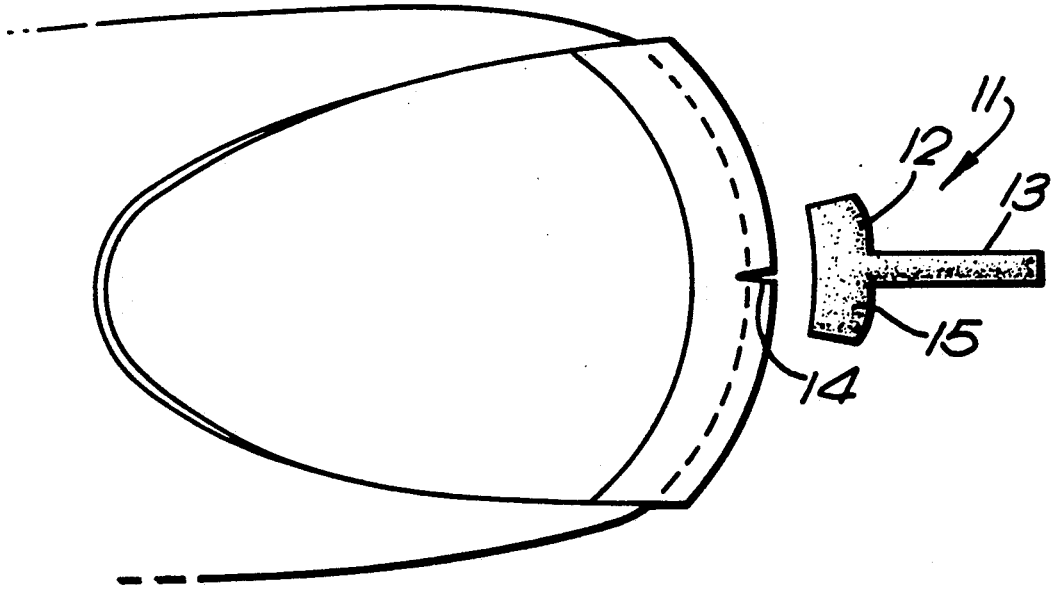

FIGS. 3*a*, 3*b*, and 3*c* show the nail means of FIGS. 1 and 2 in use;

FIG. 4 is a partial diagrammatic section on FIG. 3*b*;

FIG. 5 is a plan view of an alternative embodiment for repairing a split nail; and, FIGS. 6*a*, 6*b*, 6*c*, and 6*d* show further steps which may be taken after the steps of FIGS. 3*a*, 3*b*, and 3*c*.

In the drawings a nail means 1 comprises a support portion 2 and a handle portion 3. The support portion 2 has an arcuate leading edge 4, an upper surface 5, and is preferably of a width W substantially consistent with the width of a natural fingernail. As can be seen best from FIGS. 1 and 2, the support portion 2 and the handle portion 3 are curved about the longitudinal axis of the nail means and the handle portion is inclined downwardly with respect to the support portion 2 and preferably is stronger.

On the upper surface 5 of the support portion 2 there is provided a lip 6 which defines a forward surface 7. This serves to locate the nail means 1 in the optimum position by butting up against the leading edge of the natural nail.

In use referring to FIGS. 3*a*, 3*b*, and 3*c* in particular, adhesive, such as an instant glue, is applied to the forward surface 7 of the support portion 2 (see FIG. 3*a*). The nail means 1 is then manipulated by means of handle portion 3 so as to position the support portion 2 below the natural nail to be repaired or treated and in contact with the underneath of the natural fingernail with the adhesive therebetween. The nail means is then held firmly in position to apply pressure between the handle portion 2 and the natural fingernail 8 in order to ensure that the support portion 2 and natural fingernail adhere together (see FIG. 3*b*). The handle portion 3 is then cut away from the support portion 2 and the support portion 2 can be cut down to the length of the natural nail or left a little longer if the natural nail is to be extended (see FIG. 3*c*).

If the support portion 2 is to protrude slightly beyond the leading edge of the natural fingernail 8 this may leave a step 9 as illustrated in FIG. 4 depending upon the size of the natural fingernail. If desired this step or any gap may be filled with instant adhesive and an acrylic powder applied so as to fill the step and provide a smooth leading edge which may be filed or buffed to the desired finish. In the case of a split nail with a split 10 the split will also be covered with instant adhesive and acrylic powder.

In the embodiment of FIG. 5 the nail or repair means 11 includes a repair portion 12 and a handle portion 13. In this embodiment the repair portion 12 is of much smaller width than the natural nail and is designed just to be positioned under a split 14 as indicated. The upper surface 15 of the repair portion 12 may include a lip if desired in a similar manner to the preferred embodiments of FIGS. 1 to 4 although, as in the case of the first embodiment, such a lip is not essential.

The treated nail now grows with the support or repair portion 2, 12 permanently in position on the underside of the natural fingernail until the split or defect being corrected has grown out. The nail means is preferably a unitary clear plastics member and may be used by men or women as, once repaired, the support portion may be hardly visible except on close inspection.

The nail means is designed for fingernail repair or for cosmetic enhancement of the appearance of a natural fingernail by making the nail larger or more curved or the nail means may be used for both purposes simultaneously. The nail means may also be trimmed to provide an extension to the nail.

Figure 6A:
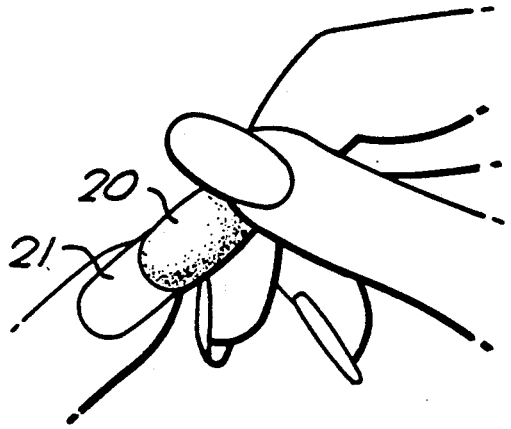
Figure 6B:
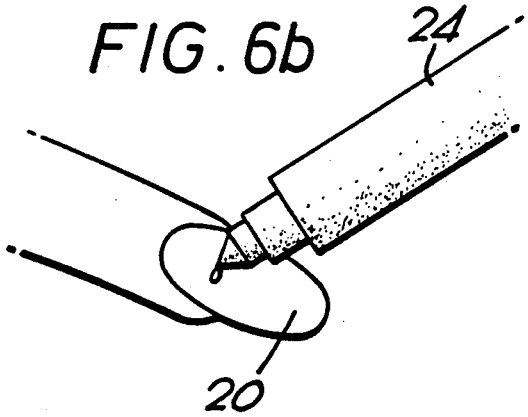
Figure 6C:
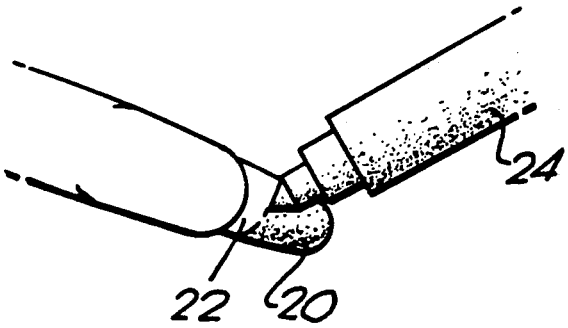
Figure 6D:
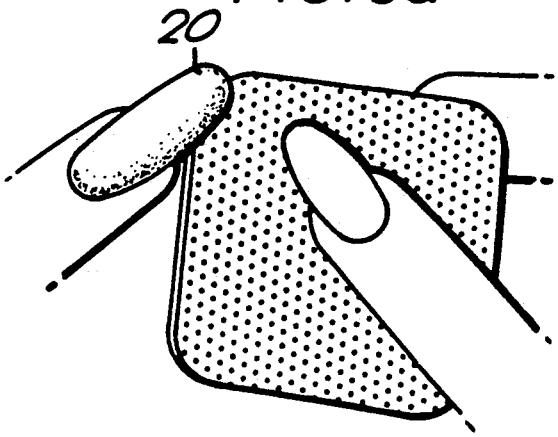

If desired the appearance of the natural fingernail may be further enhanced by the application of a separate nail extension to a natural fingernail which has already had a nail means applied to further extend the natural nail. For example, FIGS. 6*a* to 6*d* show the application of a nail extension 20 to a natural fingernail the appearance of which has already been enhanced by the steps of FIGS. 3*a* to 3*c*. In this arrangement the nail extension 20 has adhesive applied to the underside at one end and then is positioned over the natural nail 21 including the nail means 22 affixed thereto trimmed as shown in FIG. 3*c* to leave sufficient length protruding (FIG. 6*a*). The join between the nail extension 20 and the nail means 22, both of which are made of plastics material, is then blended together top (FIG. 6*b*) and bottom (FIG. 6*c*) using a suitable solvent applicator 24. Finally, the extended nail is buffed to shape as desired using a buffing pad as shown in FIG. 6*d*.

The nail extension 20 suitably may include a rebated edge (not shown) in order to facilitate butting of the nail extension 20 to the natural fingernail 21 including the nail means 22. The nail means, and nail extension if applied, grow with the natural fingernail to which they have been applied.

What is claimed is:

1. A method of repairing a split or broken natural fingernail or cosmetically enhancing the appearance of a natural fingernail comprising the steps of:

providing a nail means having a support portion and a handle portion by which the support portion may be manipulated;

applying adhesive to at least a portion of an underneath surface of the natural fingernail or the support portion;

manipulating the nail means so as to position the support portion in contact with the underneath of the natural fingernail with the adhesive therebetween so as to secure the nail means to the underneath of the natural fingernail; and separating the handle portion from the support portion.

2. The method of claim 1 further including the step of shaping the support portion as desired.

3. The method of claim 1 comprising applying acrylic powder to the support portion with adhesive at an edge of the natural nail to enhance the appearance thereof.

4. The method of repairing or cosmetically enhancing the appearance of a natural fingernail of claim 1 further including the step of extending the natural nail including nail means affixed thereto, said step comprising separating the handle portion from the support portion so as to leave a part of the support portion extending forward of the natural nail, providing a nail extension, applying adhesive to at least a portion of the underneath surface of the nail extension or a top surface of the nail means, applying the nail extension to the nail means with a join; and blending the join between the nail means and the nail extension with means for blending.

5. The method of claim 4, wherein the blending means includes a solvent and an applicator.

6. The method of repairing or enhancing the appearance of a fingernail of claim 1, the natural fingernail having a tip which is curved across its width thereof, the nail means comprising a support portion for adhesively securing the nail means to said underneath surface of the natural fingernail; a leading edge and a trailing edge on said support portion, the leading edge of the support portion being curved to substantially match the curvature of the natural fingernail tip in a complimentary manner; and a separable handle portion, distinct from the support portion and connected to the trailing edge of the support portion, by which the support portion may be manipulated into position underneath the natural nail, the handle portion extending away from the central portion of the trailing edge and having a lateral extension substantially less than the lateral extension of the leading edge of the support portion, the handle portion being separated from the support portion when the support portion has been secured in position with the leading edge of the support portion underneath the natural fingernail.

7. A nail means for repairing a split or broken natural fingernail or cosmetically enhancing the appearance of a natural fingernail, the natural fingernail having a tip which is curved across its width thereof, the nail means comprising a support portion for adhesively securing the nail means to an underneath surface the natural fingernail; a leading edge and a trailing edge on said support portion, the leading edge of the support portion being curved to substantially match the curvature of the natural fingernail tip in a complimentary manner, the leading edge extending laterally a distance sufficient to be substantially consistent with the width of the natural fingernail tip; and a separable, elongated handle portion, distinct from the support portion and connected to the trailing edge of the support portion, by which the support portion may be manipulated into position underneath the natural nail, the elongated handle portion extending away from a central portion of the trailing edge and having a lateral extension substantially less than the lateral extension of the leading edge of the support portion, the handle portion being separated from the support portion when the support portion has been secured in position with the leading edge of the support portion underneath the natural fingernail.

8. The nail means of claim 7, wherein the handle portion is made of thicker material than the support portion and is inclined or curved away from the trailing edge of the support to improve an application of pressure.

9. A nail means for repairing a split or broken natural fingernail or cosmetically enhancing the appearance of a natural fingernail, the natural fingernail having a tip which is curved across its width thereof, the nail means comprising a support portion for adhesively securing the nail means to an underneath surface of the natural fingernail; a leading edge and a trailing edge on said support portion, the leading edge of the support portion being curved to substantially match the curvature of the natural fingernail tip in a complimentary manner; and a separable handle portion, distinct from the support portion and connected to the trailing edge of the support portion, by which the support portion may be manipulated into position underneath the natural nail, the handle portion extending away from the central portion of the trailing edge and having a lateral extension substantially less than the lateral extension of the leading edge of the support portion, the handle portion being separated from the support portion when the support portion has been secured in position with the leading edge of the support portion underneath the natural fingernail.

10. The nail means of claim 9, wherein the support portion has an upper surface which is stepped to provide a lip.

11. The nail means of claim 9, wherein the handle portion is made of a thicker material than the support portion and is inclined or curved away from the trailing edge of the support portion to improve an application of pressure.

* * * * *